United States Patent [19]

Mueller

[11] 4,117,833

[45] Oct. 3, 1978

[54] EXHAUST HOOD WITH ADJUSTABLE AIR INJECTION NOZZLE

[76] Inventor: Robert H. Mueller, Rte. 2, Box 34, Sheboygan Falls, Wis. 53085

[21] Appl. No.: 769,372

[22] Filed: Feb. 16, 1977

[51] Int. Cl.[2] ..... F21C 15/08; F23J 11/00

[52] U.S. Cl. ..... 126/299 D; 55/DIG. 36; 98/40 N; 239/511

[58] Field of Search ..... 126/299 D, 299 E; 55/DIG. 36; 98/36, 40 VT, 40 E, 40 R, 108, 40 N; 239/511, 513, 521

[56] References Cited

U.S. PATENT DOCUMENTS

| | | | |
|---|---|---|---|
| 2,057,494 | 10/1936 | Leigh | 98/40 VT |
| 3,366,363 | 1/1968 | Hogan et al. | 98/40 A |
| 3,457,850 | 7/1969 | Sweet et al. | 126/299 D |
| 3,664,255 | 5/1972 | Kuechler | 126/299 D |

FOREIGN PATENT DOCUMENTS

| | | | |
|---|---|---|---|
| 1,432,145 | 4/1976 | United Kingdom | 98/40 E |

*Primary Examiner*—Ronald C. Capossela
*Attorney, Agent, or Firm*—Joseph P. House, Jr.

[57] ABSTRACT

An exhaust hood for kitchens, spray booths, etc., is provided with an air intake plenum having a nozzle spout which is adjustable to inject air from the plenum into the hood on selectively different injection paths. The nozzle spout desirably has an adjustable lip which is perforated. The spout turns on a bearing for adjustment purposes and there are flexible seals between the plenum and the nozzle spout.

12 Claims, 5 Drawing Figures

EXHAUST HOOD WITH ADJUSTABLE AIR INJECTION NOZZLE

BACKGROUND OF THE INVENTION

Exhaust hoods which supply a substantial percentage of the air to the hood from a remote source, such as outside air, are shown in issued U.S. patents; for example, U.S. Pat. Nos. 3,457,850, 3,664,255 and 3,978,777. In these patents most of the air drawn through the hood is supplied from a source of outside air. By the use of such apparatus there is a great reduction in the demand for inside air to service the hood. In both hot and cold weather, such apparatus greatly reduces the load on the heating or cooling system of the building in which the hood is located.

It is important in devices of this character that the air injected into the hood from the remote source be directed substantially directly at the grease filter which typically intervenes between the air intake plenum and the air exhaust duct. In new construction, the direction of the air injected into the hood can be established by vanes and deflectors which will produce the desired angle of incidence of the injected air on the filter. However, when modifying an old hood installation which originally did not inject outside air into the hood, thus to adapt or convert such an old hood to utilize outside air as the major component of air drawn through the hood, it is difficult to prefabricate an air intake plenum air injection nozzle which will properly direct the air at the filter because the filter position and incline will vary from one installation to the next.

Moreover, the temperature of outside air drawn through the hood will vary during different seasons of the year. Accordingly, air density will vary from time to time and a nozzle which directs air on a proper path toward the filer at one time will not properly direct the air on a proper path toward the filter at a different time.

The devices of the prior art do not lend themselves to easy adjustment of the angle of incidence of air to the filter and are inadequate to accommodate for changes in seasons and utilization of a standard outside air injection nozzle with different existing hood installations.

SUMMARY OF THE INVENTION

In accordance with the present invention, a novel standard remote air intake plenum having an adjustable nozzle spout is provided. This standard unit may be added to any existing hood which does not have an air intake from a remote source, such as outside air, and the adjustability of the spout greatly facilitates setting up the installation so that the air injected through the spout is at the correct angle with respect to the grease filter, regardless of the specific position or inclination of the grease filter in the original construction. Moreover, the nozzle spout of the present invention is mounted on a bearing which can be controlled in accordance with the temperature of the outside air and the incline of the spout adjusted in accordance with such temperature in order to automatically compensate for temperature changes which would also change the path of the injected air within the hood.

For this purpose the plenum chamber of a device embodying the present invention is provided with a nozzle spout opening, a nozzle spout in the opening and a bearing on which the nozzle spout is turnable in said opening to inject air from the plenum into the hood at different selected angles and paths.

Another feature of the present invention is an adjustable lip which is connected to the spout and which is adjustable with respect to the air flowing through the spout to further influence the path of air flowing therethrough. In preferred embodiments, the lip is hinged to the lower edge of the spout and is provided with openings such as perforations, thus adapting the device to divert some air from its original path through the perforations and develop a blanket of slowly moving air below the level of the air flowing along the original path of air through the spout.

In preferred embodiments, the nozzle comprises a laterally elongated box-like spout in which there are restrictions which throttle the air flowing therethrough, thus to provide back pressure and result in a uniformly distributed stream of air into the hood along the entire width of the nozzle spout.

The bearing on which the nozzle spout turns is also desirably provided with automatic adjusting mechanism responsive to the temperature of air brought in from the outside so that the inclination of the nozzle spout is automatically adjusted to compensate for differences of outside temperature and air density.

Other objects, features and advantages of the invention will appear from the disclosure hereof.

DESCRIPTION OF THE PREFERRED EMBODIMENTS

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

The present invention is intended for utilization in any type of exhaust hood. An important field of use is in kitchen range hoods and particularly institutional kitchen range hoods utilized in restaurants, as typified by the range hoods illustrated in the patents hereinbefore mentioned. However, the invention can also be used in other environments, for example, in industrial paint spray booths where it is desired to inject outside air into the spray booth to carry away paint fumes, etc., without adding substantially to the heating or cooling load of the building.

Figure 3:
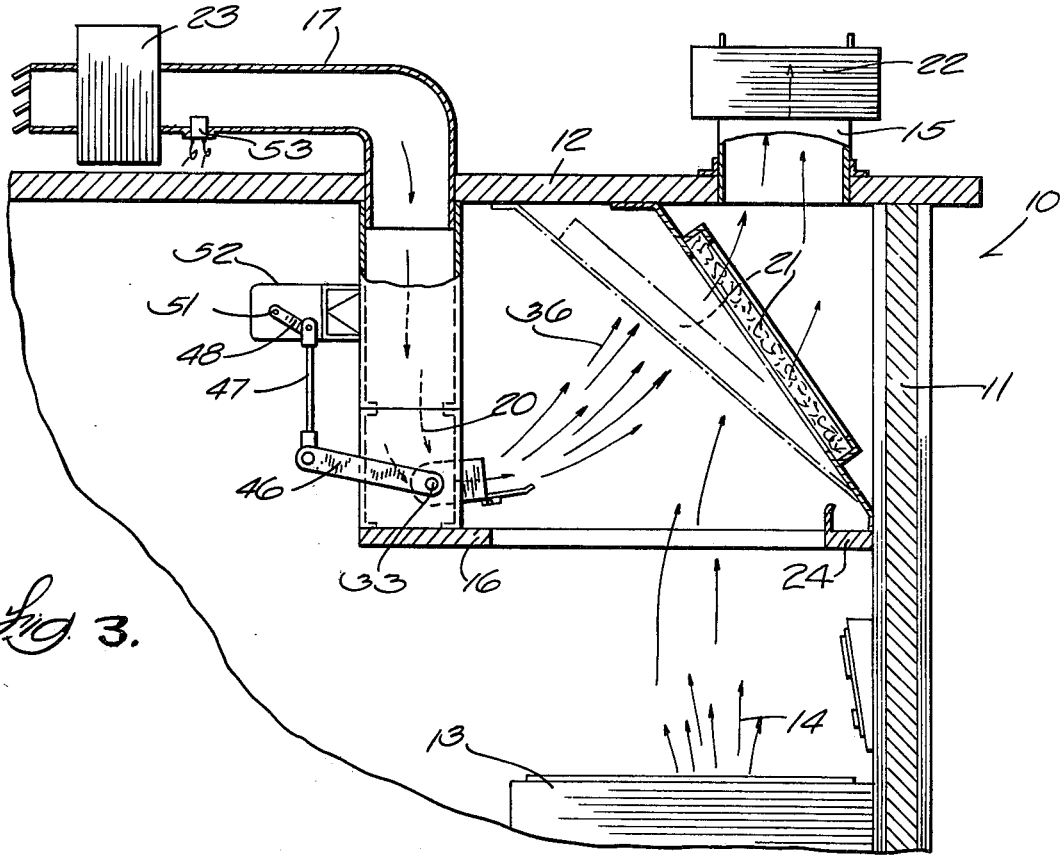
FIG. 3 is a fragmentary cross section taken through a building and through a range hood embodying the present invention.

FIG. 3 illustrates a building 10 having a side wall 11 and a roof 12. A kitchen cooking range 13 generates fumes illustrated at 14. These fumes are exhausted from the building through the exhaust duct 15 leading from the exhaust hood 16 over the range 13.

For the reasons aforestated, outside air can be brought into the exhaust hood 16 through an intake duct 17 which discharges into an air injection plenum 20.

Such hoods 16 are typically provided with a grease filter 21 mounted at an incline across the upper corner of the hood and intervening between the air intake plenum 20 and the exhaust duct 15. Most of the air exhausted through duct 15 is injected into the hood 16 through the air intake plenum and this air picks up or aspirates the fumes 14 from the range 13 to exhaust the same from the building without imposing the substantial load on the heating or cooling system for the building.

As is typical in these installations, the exhaust air is impelled through exhaust duct 15 by blower 22 and air is furnished to plenum 20 through duct 17 by blower 23.

Most current installations of exhaust hoods lack the outside air injection apparatus 17, 20, 23 as above described and most such existing installations derive their entire source of exhaust air from the building in which the exhaust hood is mounted. Accordingly, there is currently a great demand for converting these older installations to enjoy the energy saving advantages of reducing the load on the heating and cooling facilities for the building by utilizing the air make-up arrangement of FIG. 3 of the building and as hereinbefore described.

As before indicated, range hoods typically have a grease filter 21. There is no particular standard in such installations for the incline of the grease filter. Different possible inclinations for the grease filter are indicated in FIG. 3 in full lines and broken lines, thus to indicate typical variations. The grease from filter 21 is drained into the trough 24.

One advantage of the present invention is to make it possible to enable the converter unit installer to utilize a one-design or standard air injection nozzle unit to fit substantially all existing exhaust hoods, regardless of the inclination of the grease filter 21. For this purpose the plenum 20 is provided with an air injection nozzle spout 25 which is swingable or turnable in its seat in the plenum chamber 20, whereby to inject the air on a path which will strike the grease filter 21 at substantially a right angle, this being the desired angle of incidence of the injected air on the filter.

Plenum 20 is accordingly provided with a nozzle spout opening 26 which is somewhat larger than the vertical height of the spout 25. Opening 26 is provided with rubber, plastic or similar flexible and resilient seals 27 which span between the plenum wall about the nozzle spout 25 and the spout to seal therebetween in any adjusted position of the spout 25.

Nozzle 25 desirably comprises a laterally elongated box-like spout having a top wall 30, a bottom wall 31 and end walls 32. Near their rear ends the side walls 32 are mounted on a bearing shaft 33 which is journaled on bearing blocks 34 of plenum chamber side walls 35. Accordingly, rotation of shaft 33 will turn the spout 25 about the axis of shaft 33 between its various positions, for example, those illustrated in full and dotted lines in FIG. 4 of the drawings, thus to adjust the path of air flow indicated by the arrows 36 in FIG. 3 of the drawings. This enables the installer to adjust nozzle spout 25 to ensure that the input air injected into the exhaust hood 16 will intersect the grease filter 21 at substantially a right angle.

The lower wall 31 of the spout 25 is provided with a lip 37 connected thereto by a hinge 40. Lip 37 can readily be swung about its hinge 40 to function as a deflector or vane to further control the path of flow of air injected into the exhaust hood. Lip 37 is adjustably supported on one or more threaded bolts 41 which are welded or otherwise attached to spout top 30 and which extend through suitable holes or slots in the lip 37.

Figure 4:
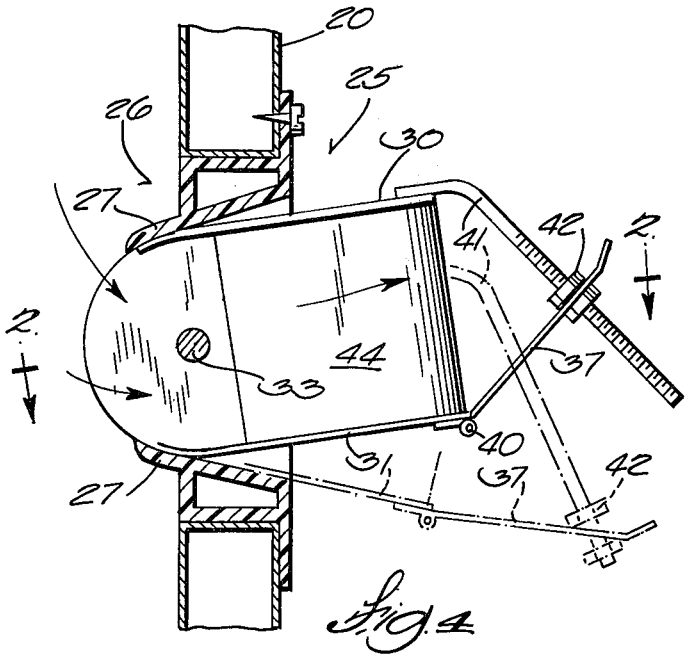
FIG. 4 is a vertical cross section taken through a nozzle spout and the adjacent portions of an air intake plenum embodying the present invention, along the line 4—4 of FIG. 2.
Figure 5:
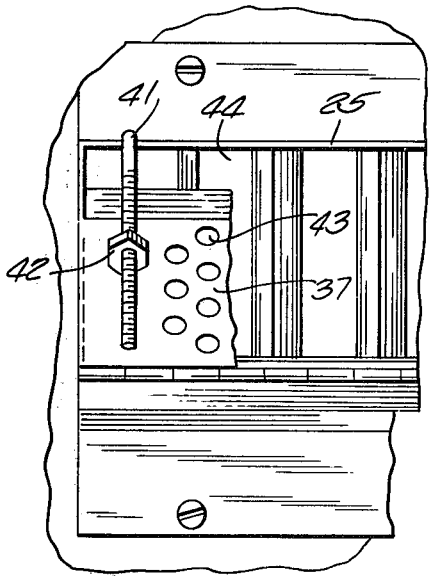
FIG. 5 is a fragmentary elevation viewing the apparatus of FIG. 4 from the right side thereof.

In preferred embodiments, the lip 37 is perforated or is otherwise provided with openings 43 as indicated in the drawings. Accordingly, if the lip is elevated, for example, into its full line position as shown in FIG. 4, so that it extends into the path of air injected through the nozzle spout 25, some of the air will strike the elevated lip 37 and will flow through the holes 43 in the lip to thus create a blanket of slower moving air just below the path of the air flowing through the nozzle spout 25 and over the edge of lip 37. This lower velocity blanket of air is advantageous in picking up the fumes 14 from the range 13 and evenly distributing the fumes through the grease filter 21.

Figure 1:
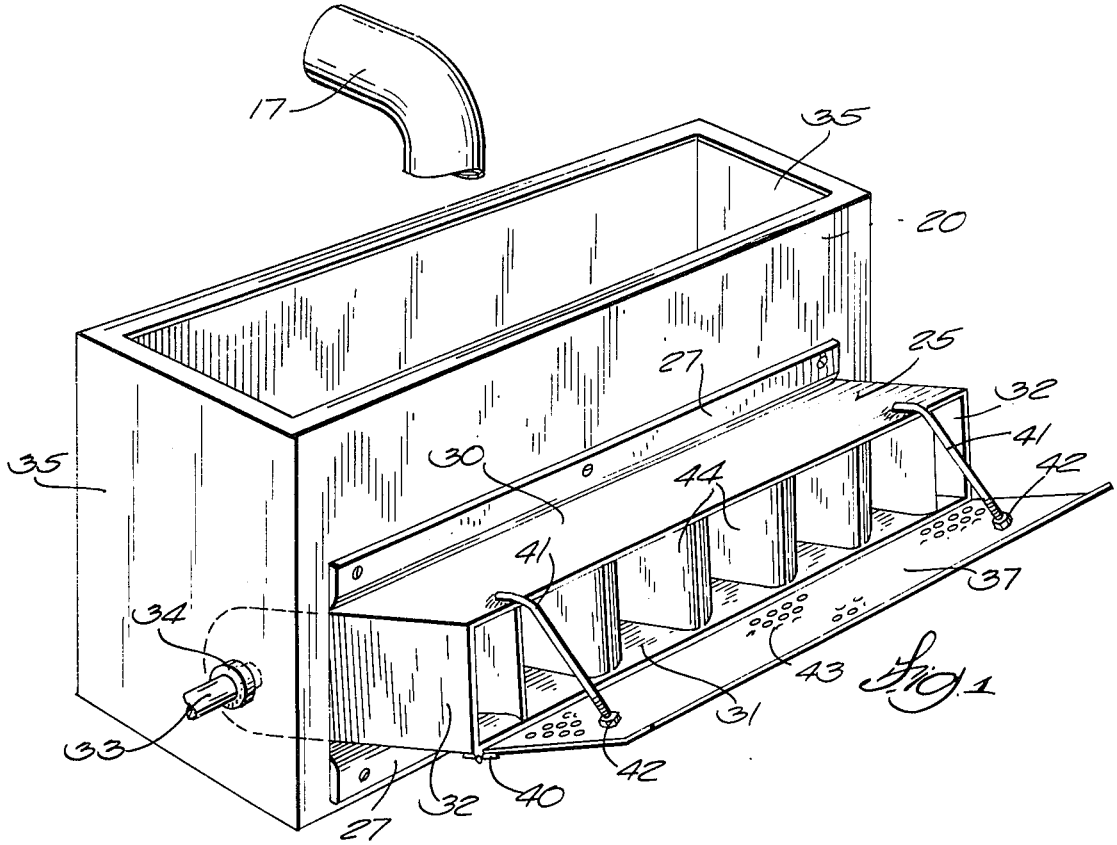
FIG. 1 is a perspective view of an air intake plenum with adjustable nozzle spout embodying the invention.
Figure 2:
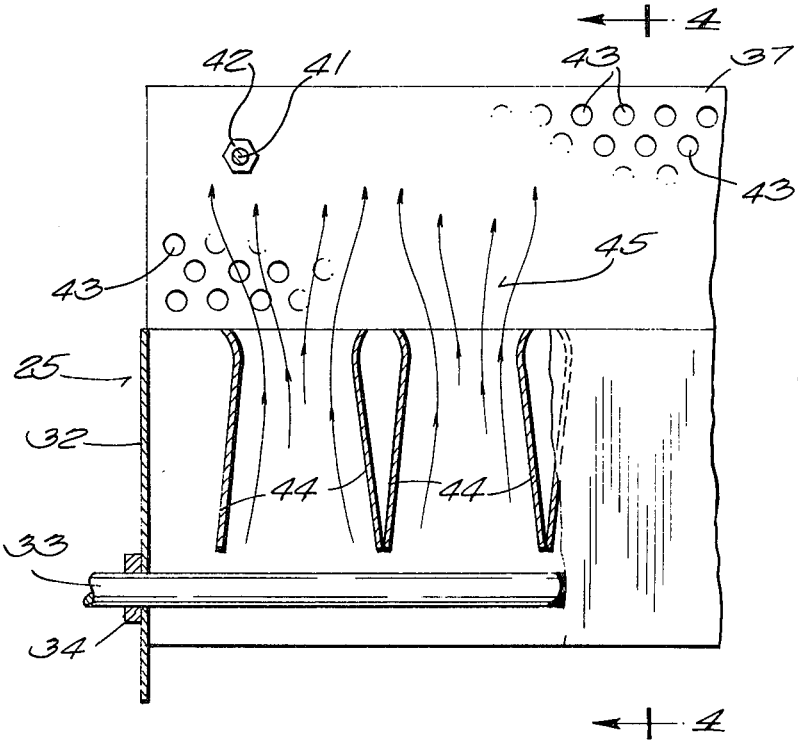
FIG. 2 is a fragmentary cross section taken along the line 2—2 of FIG. 4.

The nozzle spout 25 is also desirably provided with nozzle restriction baffles 44 which span between the top and bottom walls 30, 31 of the spout 25 and which converge toward the outlet of the spout. Accordingly, air flowing through the spout along the streamlines 45 in FIG. 2 will likewise converge, thus producing back pressure on the air within the plenum 20. This back pressure will result in uniformity of flow of the air along the laterally elongated spout 25.

In preferred embodiments, automatic mechanism is provided to adjust the position of the spout 25, depending on changing conditions of temperature of the air drawn in by blower 23 in intake duct 17. For this purpose shaft 33 is provided with a crank arm 46 connected by link 47 to crank arm 48 of shaft 51 of a motor 52 which is controlled in response to the temperature of the air as sensed by thermostat 53. Accordingly, if the outside temperature drops so that the temperature of the air drawn in through duct 17 is low and hence tends to fall by gravity in the hood 16, motor 52 will respond to turn nozzle spout 25 upwardly and maintain the angle of incidence of air 36 at a right angle to the filter 21. Conversely during hot weather when the temperature of the air drawn through intake duct 17 is high, motor 52 will respond to turn the spout 25 to a lower level to compensate for the tendency of this warmer air to rise in the hood 16. This maintains the air on a flow path within the hood which is at substantially a right angle to the filter 21.

I claim:

1. In an exhaust hood having an input air plenum, an air exhaust duct and a filter therebetween, the improvement for adjusting the path of air introduced through said input air plenum into said hood with respect to the position of the filter, said improvement comprising said input plenum having a nozzle spout opening, a nozzle spout in said opening and a bearing on which said nozzle spout is turnable in said opening to inject air from said plenum into said hood at the desired angle of incidence to said filter, said nozzle spout having a lip and a hinge on which the lip is adjustably connected to the spout to function as a deflector to further control the path of flow of air injected into the exhaust hood by the spout.

2. The device of claim 1 in which said nozzle spout comprises a generally rectangular box.

3. The device of claim 1 in which said plenum is provided with flexible seals between said nozzle spout and said nozzle spout opening.

4. The device of claim 1 in which said nozzle spout is laterally elongated and is provided with a series of nozzle restriction baffles to throttle air flow through the spout.

5. The device of claim 1 in combination with means for turning said nozzle spout on its bearing automatically in response to variations in the temperature of said input air.

6. In an exhaust hood having an input air plenum, an air exhaust duct and a filter therebetween, the improvement for adjusting the path of air introduced through said input air plenum into said hood with respect to the position of the filter, said improvement comprising said input plenum having a nozzle spout opening, a nozzle spout in said opening and a bearing on which said nozzle spout is turnable in said opening to inject air from said plenum into said hood at the desired angle of incidence to said filter, said nozzle spout having an adjustable lip which comprises a plate having openings for flow of air therethrough.

7. Apparatus for injecting air into an exhaust hood and comprising a plenum, a nozzle spout opening in said plenum, a nozzle spout in said opening and a bearing on which said nozzle spout is turnable in said opening to inject air from said plenum into the hood on different injection paths, said nozzle spout having a lip and a hinge on which the lip is adjustably connected to the spout to function as a deflector to further control the path of flow of air injected into the exhaust hood by the spout.

8. The device of claim 7 in which said nozzle spout comprises a generally rectangular box.

9. The device of claim 7 in which said plenum is provided with flexible seals between said nozzle spout and said nozzle spout opening.

10. The device of claim 7 in which said nozzle spout is laterally elongated and is provided with a series of nozzle restriction baffles to throttle air flow through the spout.

11. The device of claim 7 in combination with means for turning said nozzle spout on its bearing automatically in response to variations in the temperature of said input air.

12. Apparatus for injecting air into an exhaust hood and comprising a plenum, a nozzle spout opening in said plenum, a nozzle spout in said opening and a bearing on which said nozzle spout is turnable in said opening to inject air from said plenum into the hood on different injection paths, said nozzle spout having an adjustable lip extending therefrom, said lip comprising a plate having openings for flow of air therethrough.

* * * * *